United States Patent [19]

Yasuda et al.

[11] Patent Number: 4,975,150

[45] Date of Patent: Dec. 4, 1990

[54] METHOD FOR PREVENTING PLUGGING OF SUCTION ROLL OF PAPER MACHINE AND ANTI-PLUGGING AGENT THEREFOR

[75] Inventors: Koji Yasuda; Yasuyuki Hirano, both of Mie, Japan

[73] Assignee: Hakuto Chemical Co., Ltd., Tokyo, Japan

[21] Appl. No.: 276,737

[22] Filed: Nov. 28, 1988

[30] Foreign Application Priority Data

Nov. 26, 1987 [JP] Japan ..... 62-296079

[51] Int. Cl.[5] ..... D21F 1/00; D21F 3/00

[52] U.S. Cl. ..... 162/199; 162/276; 162/279

[58] Field of Search ..... 162/199, 364, 276, 279, 162/272; 210/767, 674, 780; 134/3

[56] References Cited

U.S. PATENT DOCUMENTS

| | | | |
|---|---|---|---|
| 4,113,557 | 9/1978 | Kankaanpää | 162/364 X |
| 4,661,261 | 4/1987 | Chambers | 210/698 |
| 4,715,931 | 12/1987 | Schellhamer et al. | 162/199 |

*Primary Examiner*—David Simmons
*Assistant Examiner*—Thi Dang
*Attorney, Agent, or Firm*—Sughrue, Mion, Zinn, Macpeak & Seas

[57] ABSTRACT

A method for preventing plugging of a suction roll of a paper machine is described, which includes showering sealing water having incorporated therein from 10 to 500 ppm by weight, based on the sealing water, of malic acid on an inner wall of a shell of the suction roll.

2 Claims, No Drawings

METHOD FOR PREVENTING PLUGGING OF SUCTION ROLL OF PAPER MACHINE AND ANTI-PLUGGING AGENT THEREFOR

FIELD OF THE INVENTION

This invention relates to method for continuously preventing plugging of a suction roll of paper machines and an anti-plugging agent therefor.

BACKGROUND OF THE INVENTION

Paper machines have suction rolls of various types at the wire part and press part thereof for dehydration or squeezing. Typical suction rolls include a suction couch roll, a suction pickup roll, a suction press roll, and a linger roll. These rolls comprise a revolving shell with a number of openings which is made of stainless steel or bronze and a fixed suction box inside the shell by which liquid is sucked up. However, with the progress of paper making, insoluble matters of various inorganic components, loading materials, fibers, resinous components, etc., contained in white water stick to the shell to form scales. The formed scales plug the shell openings to gradually reduce a dehydrating, squeezing or sucking function, not only resulting in deterioration of the operation rate or operational efficiency but causing unevenness in the water content of paper which would lead to deteriorated quality, such as poor formation and uneven drying properties. Besides, the portion of the roll in direct contact with the scales is susceptible to corrosion, ultimately leading to breaking of the roll in the worst situation.

In paper manufacturing factories, this problem has been coped with by periodically exchanging suction rolls. Since the rate of plugging is frequently accelerated through variation of operating conditions, the paper machine must sometimes be suspended for exchange of rolls on shorter schedules.

The scales plugging the suction roll after an exchange are usually removed by mechanical outer force with a drill or an ultra-high-pressure water jet, thereby making the roll reusable. However, since the scales are very hard and rigid and also the shell has a vast number of openings of from tens of thousands to hundreds of thousands, such mechanical treatment not only entails much labor but is liable to damage the shell openings or areas surrounding the same.

Therefore, it has been keenly demanded in the field of paper manufacturing to develop an effective method for continuously preventing suction rolls from plugging, but no method serving the purpose has been reached.

SUMMARY OF THE INVENTION

One object of this invention is to provide a method for continuously preventing a suction roll of paper machines from plugging with scales.

Another object of this invention is to provide an anti-plugging agent with which plugging of a suction roll can be continuously prevented.

As a result of extensive investigations on the mechanism of scale formation, the inventors have elucidated that, while white water passes through the shell openings, components dissolved therein, particularly aluminum ions, are insolubilized and precipitated on receipt of a pH shock by sealing water from a showering means fitted to the inside of the suction roll and that these components, while precipitating, absorb siliceous matters in the white water or sealing water and loading materials, fibrous components and resinous components in the white water to gradually form scales.

The inventors further continued their studies aiming to prevent precipitation of the dissolved components in white water. It has been hence discovered that an unexpectedly marked effect to prevent the precipitation can be produced by continuous addition of malic acid to the sealing water of the showering means fitted to the suction roll.

Although oxycarboxylic acids other than malic acid, such as glycolic acid, tartaric acid, lactic acid, gluconic acid, and citric acid, produce similar effects, they are less effective and more expensive than malic acid.

The present invention thus provides a method for preventing plugging of a suction roll of paper machines which comprises showering sealing water having incorporated therein from 10 to 500 ppm by weight, based on the sealing water, of malic acid onto the inner wall of a shell of said suction roll.

The present invention further provides an anti-plugging agent for preventing plugging of a suction roll for paper machines which comprises malic acid as an effective component.

DETAILED DESCRIPTION OF THE INVENTION

Malic acid which can be used as an anti-plugging agent is continuously fed in the form of an aqueous solution to sealing water in a showering means fitted to the inside of a suction roll. The amount of malic acid to be fed depends on the extent of plugging and is selected from the range of from 10 to 500 ppm by weight based on the sealing water. From the economical standpoint and in order to achieve complete prevention of plugging, the most preferred range of the amount is from 20 to 100 ppm.

The sealing water is not particularly limited, except that it should be fed in an amount enough to maintain sufficient air tightness between the suction roll shell and a suction box and that consideration should be taken so that the water may be uniformly distributed over the inner wall of the shell. Although the amount of the sealing water to be fed varies depending upon the size of the suction roll, it is generally within the range from several tens l/min to several hundreds l/min.

As long as the objects of this invention are met, there is no particular limitation about a combined use of other optional components, such as surface active agents, corrosion inhibitors and biocides. Preferred examples of the surface active agents include nonionic surface active agents, such as nonylphenol ethoxylates, octylphenol ethoxylates, fatty alcohol ethoxylates, fatty acid ethoxylates and propoxylated polyoxylene glycols.

The following examples are given for illustrating the present invention in greater detail, but it should be understood that the present invention is not deemed to be limited thereto.

EXAMPLE 1

White water (pH=4.2) sampled from a paper machine for manufacturing medium-quality paper was filtered through Toyo Filter Paper No. 6 made by Toyo Roshi Co., Ltd., and a prescribed amount of the additives shown in Table 1 was added to the filtrate. The filtrate was adjusted to a pH of 5 with a sodium hydroxide aqueous solution. The amount of SS (i.e., suspended solid) formed on pH adjustment was measured by means of an integrating sphere type SS densitometer (SEP-CS-500 type) made by Nippon Seimitsu Kogyo Co., Ltd. to obtain a percent prevention of precipitation (%) according to the equation:

Percent Prevention of Precipitation (%)=

$$\left(1 - \frac{SS \text{ when additive was added}}{SS \text{ when no additive was added}}\right) \times 100$$

In the above-stated measurement, pH adjustment to 5 is based on the fact that the SS value reaches the maximum at a pH around 5 when no additive is used.

TABLE 1

| Run No. | Additive | Amount Added* (ppm) | Percent Prevention of Precipitation (%) | Remark |
|---|---|---|---|---|
| 1 | none | — | — | control |
| 2 | malic acid | 20 | 28 | invention |
| 3 | " | 50 | 52 | " |
| 4 | " | 100 | 100 | " |
| 5 | glycolic acid | 20 | 8 | comparison |
| 6 | " | 50 | 14 | " |
| 7 | " | 100 | 21 | " |
| 8 | tartaric acid | 20 | 4 | " |
| 9 | " | 50 | 12 | " |
| 10 | " | 100 | 28 | " |
| 11 | gluconic acid | 20 | 0 | " |
| 12 | " | 50 | 7 | " |
| 13 | " | 100 | 12 | " |
| 14 | lactic acid | 20 | 9 | " |
| 15 | " | 50 | 12 | " |
| 16 | " | 100 | 25 | " |
| 17 | citric acid | 20 | 14 | " |
| 18 | " | 50 | 21 | " |
| 19 | " | 100 | 49 | " |

*The amount of the additive based on the filterate

EXAMPLE 2

A suction couch roll of a paper machine for manufacturing newsprint paper tended to be plugged with scales in about 1 month after replacement with a clean roll and, after the passage of 4 months, it stood no further use. It had therefore been exchanged for a clean one on a 4-month cycle. When an aqueous malic acid solution according to the present invention was continuously fed to sealing water, which was showered onto the inner wall of a shell of the roll at a rate of 120 l/min, to a concentration of 30 ppm, the openings of the shell underwent no plugging over after 7 months from an exchange. Accordingly, the necessity of exchanging suction rolls was avoided, and the dehydrating function of the suction roll was maintained, thereby considerably improving the operation rate or operational efficiency of the machine.

As described above, plugging of a suction roll due to precipitation and build-up of scales during stationary running can be effectively and economically prevented by the anti-plugging agent and the method for preventing plugging without requiring remodeling or increase of the conventional machinery including suction rolls and showering means. Workers are thereby released from the operation for mechanical removal of built-up scales from the suction roll and, at the same time, damage to a suction roll through corrosion or abrasion is avoided.

While the invention has been described in detail and with reference to specific embodiments thereof, it will be apparent to one skilled in the art that various changes and modifications can be made therein without departing from the spirit and scope thereof.

What is claimed is:

1. A method for preventing plugging of a suction roll of a paper machine which comprises showering sealing water having incorporated therein from 10 to 500 ppm by weight, based on the sealing water, of malic acid onto the inner wall of a shell of said suction roll.

2. A method as claimed in claim 1, wherein said sealing water contains from 20 to 100 ppm by weight of malic acid.

* * * * *